US008136437B2

(12) United States Patent
Van Stratum et al.

(10) Patent No.: US 8,136,437 B2
(45) Date of Patent: Mar. 20, 2012

(54) MODULAR HAND GRENADE

(75) Inventors: Bruce Van Stratum, Tallahassee, FL (US); Matthew Eckel, Perry, FL (US)

(73) Assignee: Martin Electronics, Inc., Tallahassee, FL (US)

( * ) Notice: Subject to any disclaimer, the term of this patent is extended or adjusted under 35 U.S.C. 154(b) by 168 days.

(21) Appl. No.: 12/661,718

(22) Filed: Mar. 23, 2010

(65) Prior Publication Data

US 2011/0232466 A1 Sep. 29, 2011

(51) Int. Cl.
*C06B 21/00* (2006.01)
*F42B 27/00* (2006.01)
*F42B 33/00* (2006.01)

(52) U.S. Cl. ..... 86/1.1; 102/368; 102/482

(58) Field of Classification Search ..... 86/1.1, 86/20.1, 20.11; 102/368, 482
See application file for complete search history.

(56) References Cited

U.S. PATENT DOCUMENTS 1,897,948 A * 2/1933 Young ..... 102/368
2,075,969 A * 4/1937 White et al. ..... 86/20.1
2,094,562 A * 9/1937 Lowy ..... 102/368
3,034,393 A * 5/1962 Lieberman et al. ..... 86/1.1
3,793,920 A * 2/1974 Sheran ..... 86/1.1
3,878,789 A * 4/1975 Hall ..... 102/482
3,924,510 A * 12/1975 Strunk et al. ..... 86/1.1
4,250,792 A * 2/1981 Deigmuller et al. ..... 86/1.1
4,420,440 A * 12/1983 Marz ..... 264/3.3
4,455,914 A * 6/1984 Christmann et al. ..... 86/1.1
4,651,618 A * 3/1987 Ringel et al. ..... 86/20.14
4,826,637 A * 5/1989 Maures et al. ..... 264/3.4
5,712,444 A * 1/1998 Brion et al. ..... 102/202

* cited by examiner

*Primary Examiner* — Bret Hayes
(74) *Attorney, Agent, or Firm* — J. Wiley Horton

(57) ABSTRACT

A modular hand grenade design that permits the use of compressed powders such as A-5. The hand grenade body is split into two main components—a base/sleeve and a nose cap. These two main components contain the explosive. They are loaded with explosive while still separate. The explosive is loaded into the base/sleeve and compressed to form a solid. A core sleeve is attached to the base to form a void inside the explosive where the detonating portion of a fuse assembly can be placed. Explosive is likewise loaded into the nose cap and compressed to form a solid. The nose cap is attached to the base/sleeve assembly. A fuse assembly is then attached to complete the grenade.

20 Claims, 17 Drawing Sheets

MODULAR HAND GRENADE

BACKGROUND OF THE INVENTION

1. Field of the Invention

The present invention relates generally to the field of munitions. More specifically, the invention comprises a hand grenade with a modular design allowing the components to be easily varied in order to suit particular objectives.

2. Description of the Related Art

BRIEF SUMMARY OF THE INVENTION

The present invention comprises a modular hand grenade design that permits the use of compressed powders such as A-5. The hand grenade body is split into two main components—a base/sleeve and a nose cap. These two main components contain the explosive. They are loaded with explosive while still separate. The explosive is loaded into the base/sleeve and compressed to form a solid. A core sleeve is attached to the base to form a void inside the explosive where the detonating portion of a fuse assembly can be placed. Explosive is likewise loaded into the nose cap and compressed to form a solid. The nose cap is attached to the base/sleeve assembly. A fuse assembly is then attached to complete the grenade.

Different types of nose caps can be provided to allow the grenade to be reconfigured in the field. A shaped charge nose cap allows the grenade to perform armor piercing operations. A detonator nose cap allows the grenade to be remotely detonated using an electrical signal. Many other variations are possible using the inventive design.

REFERENCE NUMERALS IN THE DRAWINGS

| | | | |
|---|---|---|---|
| 10 | hand grenade | 12 | fuse assembly |
| 14 | body | 15 | safety clip |
| 16 | pin | 18 | pull ring |
| 20 | safety lever | 22 | nose cap |
| 24 | base | 26 | sleeve |
| 28 | core sleeve | 30 | explosive |
| 32 | explosive | 34 | joint |
| 36 | male thread | 38 | female thread |
| 40 | male thread | 42 | latitude channel |
| 44 | longitude channel | 46 | flat |
| 48 | panel | 50 | female thread |
| 52 | outer mating face | 54 | wall |
| 56 | fuse receiver | 58 | boss |
| 60 | inner mating face | 62 | wall |
| 64 | nose cap receiver | 66 | base receiver |
| 68 | female thread | 70 | wall |
| 72 | core sleeve | 74 | flange |
| 76 | mating surface | 78 | tube |
| 80 | hollow interior | 82 | detonator |
| 84 | male thread | 86 | mating surface |
| 88 | delay element | 90 | gasket seat |
| 92 | locating pin | 94 | holding fixture |
| 96 | holding fixture | 98 | shaped charge nose cap |
| 100 | copper cup | 102 | detonator nose cap |
| 104 | detonator | | |

DETAILED DESCRIPTION OF THE INVENTION

Figure 1:
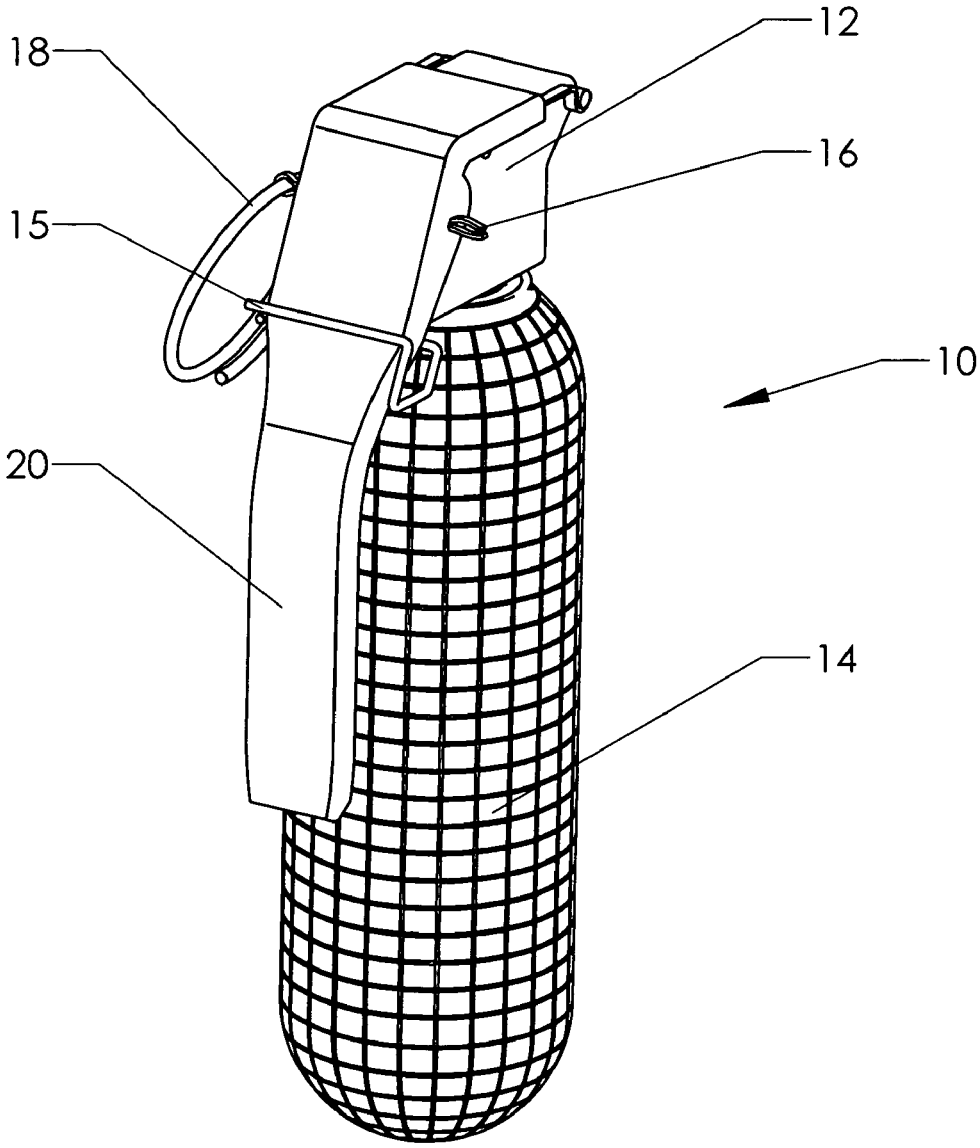
FIG. 1 is a perspective view, showing a complete hand grenade made according to the present invention.

FIG. 1 shows hand grenade 10 in an assembled state. Body 14 contains explosive and is designed to rupture into fragments upon detonation. The body includes the novel elements of the invention. It is preferably attached to a conventional fuse assembly 12. The fuse assembly includes pin 16 connected to pull ring 18. The pin secures safety lever 20 in the "safe" position as shown. Safety clip 15 prevents unintentional deployment of the safety lever. The fuse components are well understood by those skilled in the art. Several existing fuses may be adapted for use with the invention, including the M213 fuse assembly currently being used by the United States Army.

Figure 2:
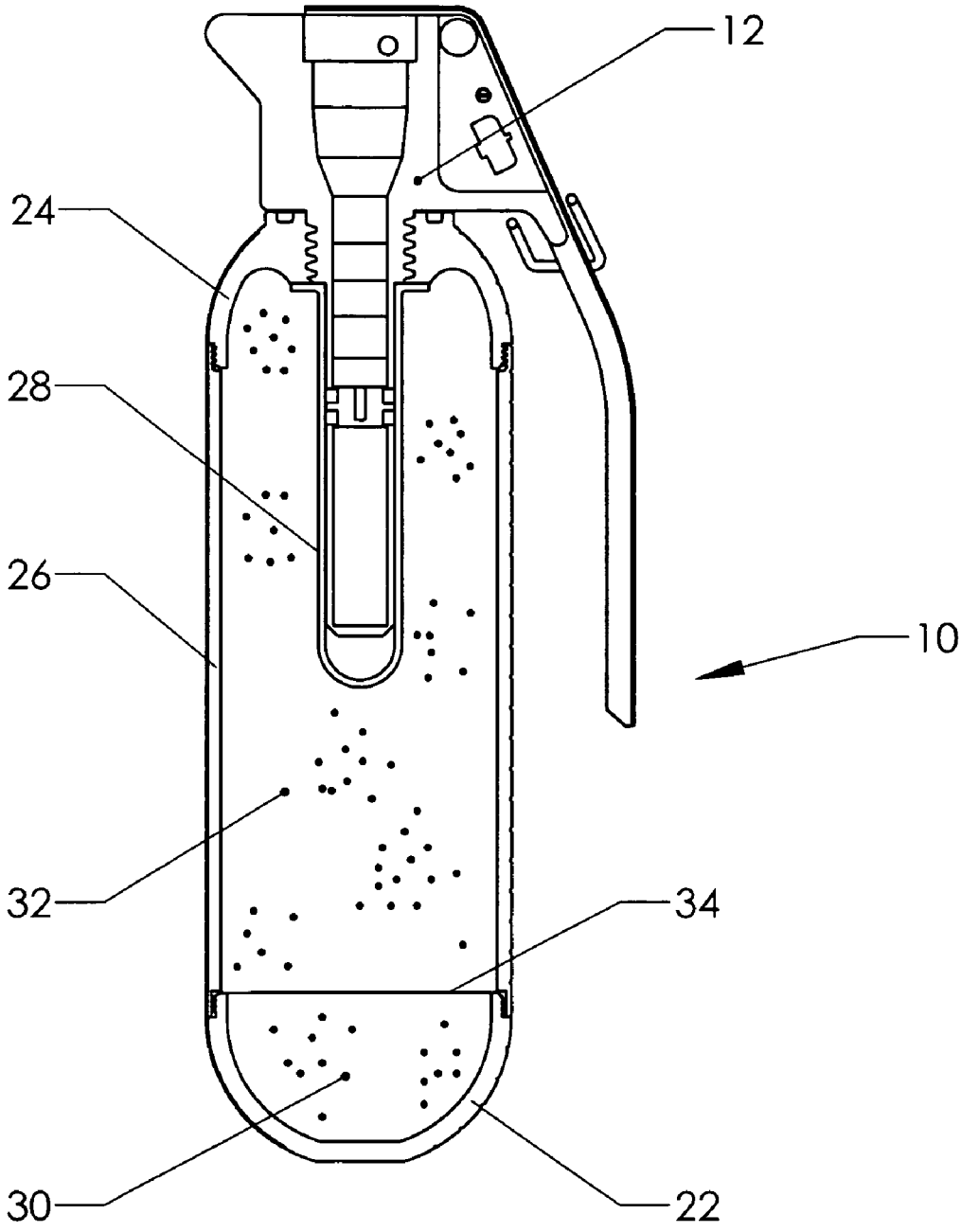
FIG. 2 is a sectional elevation view, sowing internal details.

Body 14 is formed by combined three separate components. FIG. 2 is a sectional elevation view through the hand grenade—illustrating how the three separate components are combined. Sleeve 26 is a hollow cylinder having female threads at either end. Nose cap 22—which is equipped with corresponding male threads—screws into the first end of the sleeve. Base 24—which is also equipped with corresponding male threads—screws into the second end of the sleeve. Of course, one could also create a design in which male threads are provided on the sleeve and female threads are provided on the nose cap and base.

Cores sleeve 28 is mated against the interior of base 24. It provides a housing for the inwardly protruding portion of fuse assembly 12 and keeps the fuse assembly separate from explosive 32. Explosive 30 is loaded into nose cap 22, with the two volumes of explosive meeting at joint 34.

A variety of explosives can be used, but A5 (a combination of RDX and wax) is preferred. Those skilled in the art will know that A5 must generally be pressed into place. The present design is particularly well suited to the use of A5—as will be explained subsequently.

Figure 3:
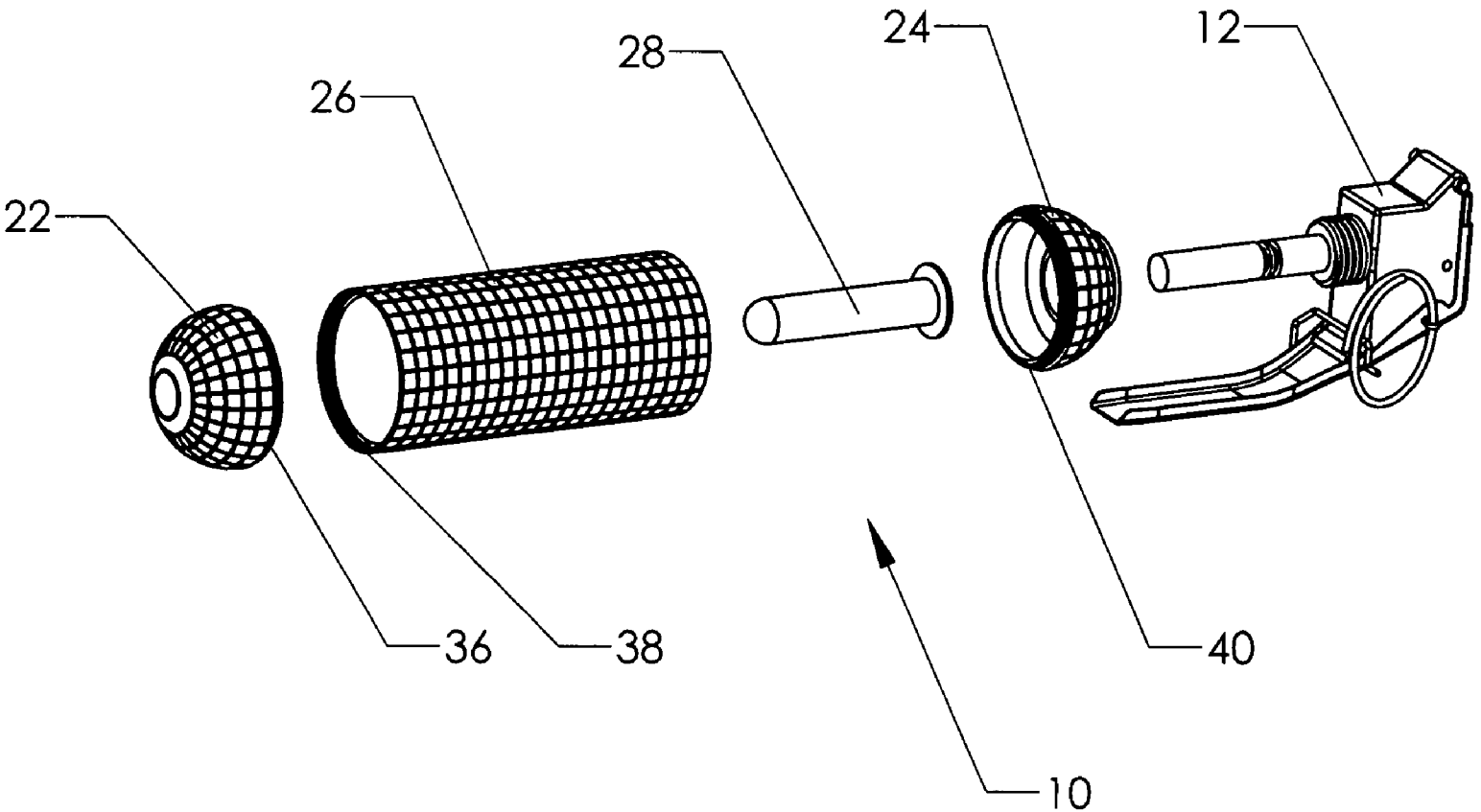
FIG. 3 is an exploded perspective view, showing the major components of the present invention in a disassembled state.

FIG. 3 shows an exploded perspective view of the components illustrated in FIG. 2. Nose cap includes male thread 36 which is sized to engage female thread 38 on a first end of sleeve 26. Core sleeve 28 fits inside sleeve 26. Base 24 is equipped with male thread 40 which engages a female thread on the second end of sleeve 26. Fuse assembly 12 screws into base 24 in still another threaded engagement.

The nose cap, sleeve, and base are preferably made of a strong and dense material such as steel. Core sleeve 28 is preferably made of a thin and ductile material such as copper. The fuse assembly is made of a variety of materials known to those skilled in the art.

Figure 4:
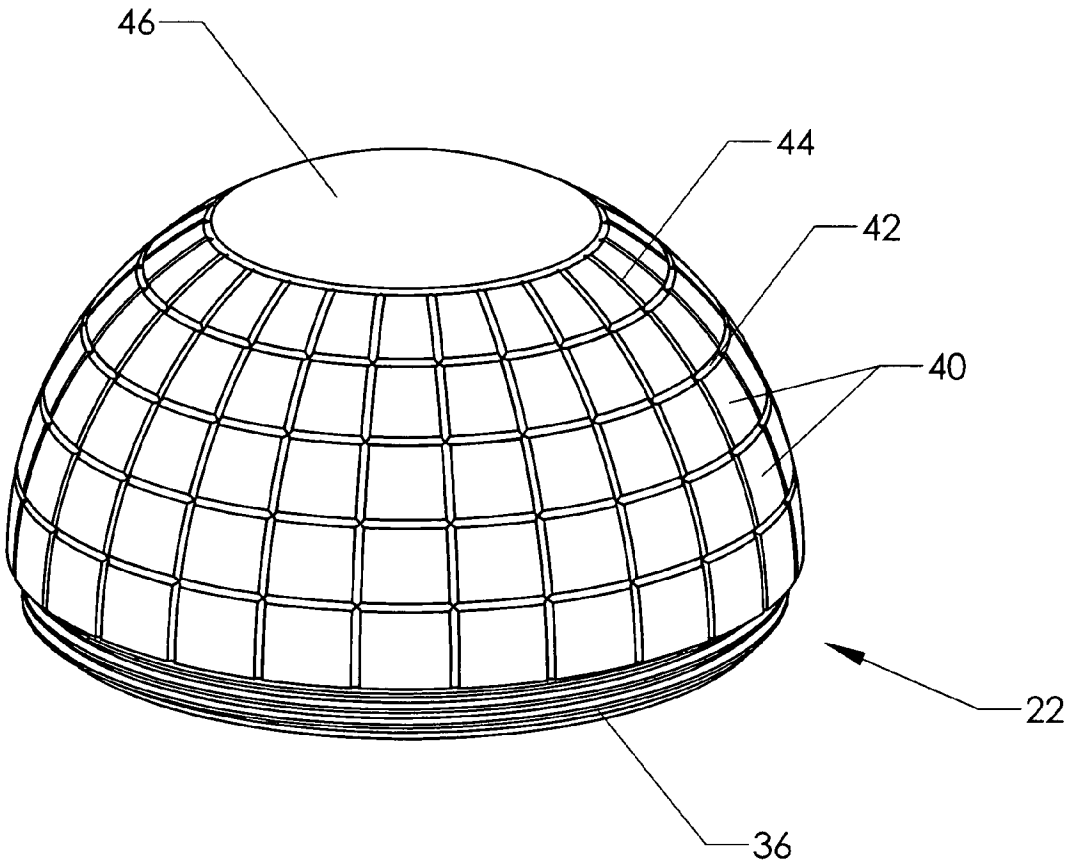
FIG. 4 is a perspective view, showing the nose cap.

FIG. 4 shows a perspective view of nose cap 22. All the components making up the body of the grenade are preferably provided with features which will cause the grenade to fragment in a predictable way. One way to accomplish this is to provide a series of channels in the interior or exterior surfaces. In the embodiment shown in FIG. 4, a series of channels are provided in the exterior surface of the nose cap. A plurality of longitude channels 44 intersect a plurality of latitude channels 42 in order to divide the exterior surface into a plurality of panels 48. When the grenade detonates, the nose cap will tend to fragment along these channels and thereby break into fragments that are approximately the size of the individual panels 48. Flat 46 may be provided on the nose cap as well.

Figure 5:
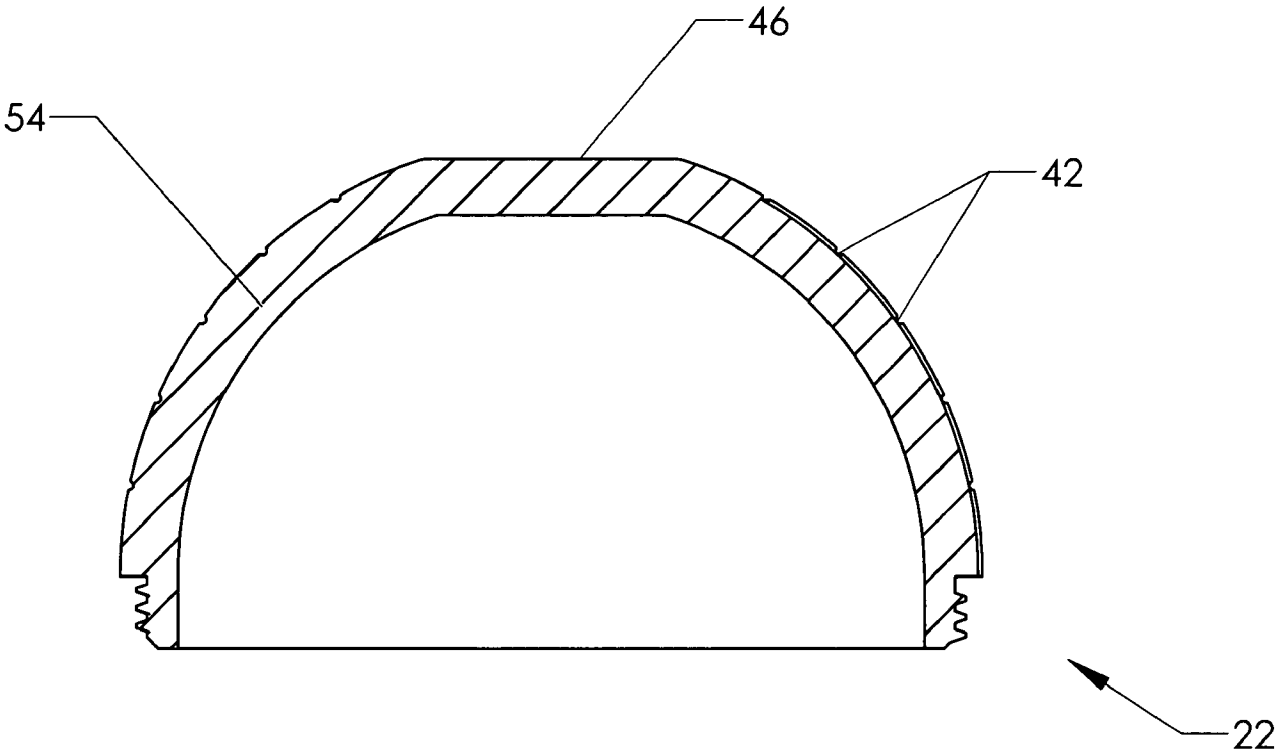
FIG. 5 is a sectional elevation view of the nose cap of FIG. 4.
Figure 6:
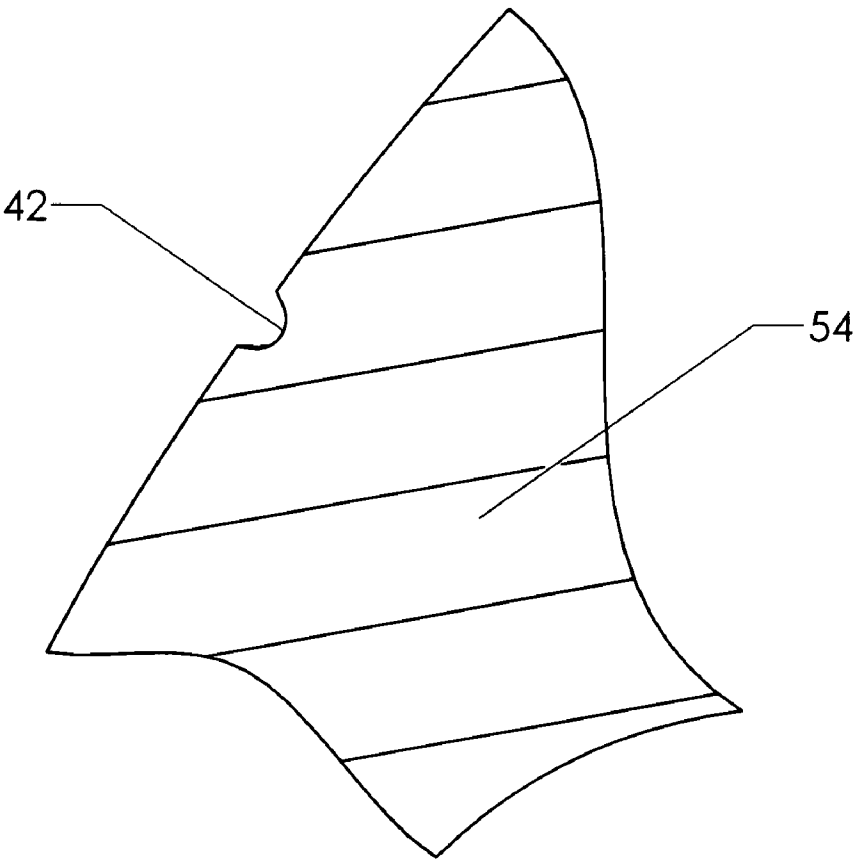
FIG. 6 is a sectional detail view, showing the wall of the nose cap.

FIG. 5 shows a sectional elevation view through the nose cap. The reader will observe how latitude channels 42 reduce the thickness of wall 54—thereby creating a local weakness which tends to promote fracture upon detonation. FIG. 6 shows this feature in greater detail. Since the channels are provided on an exterior surface, they may easily be cut by a machining process. They may also be cast into the nose cap if a casting process is used.

Figure 7:
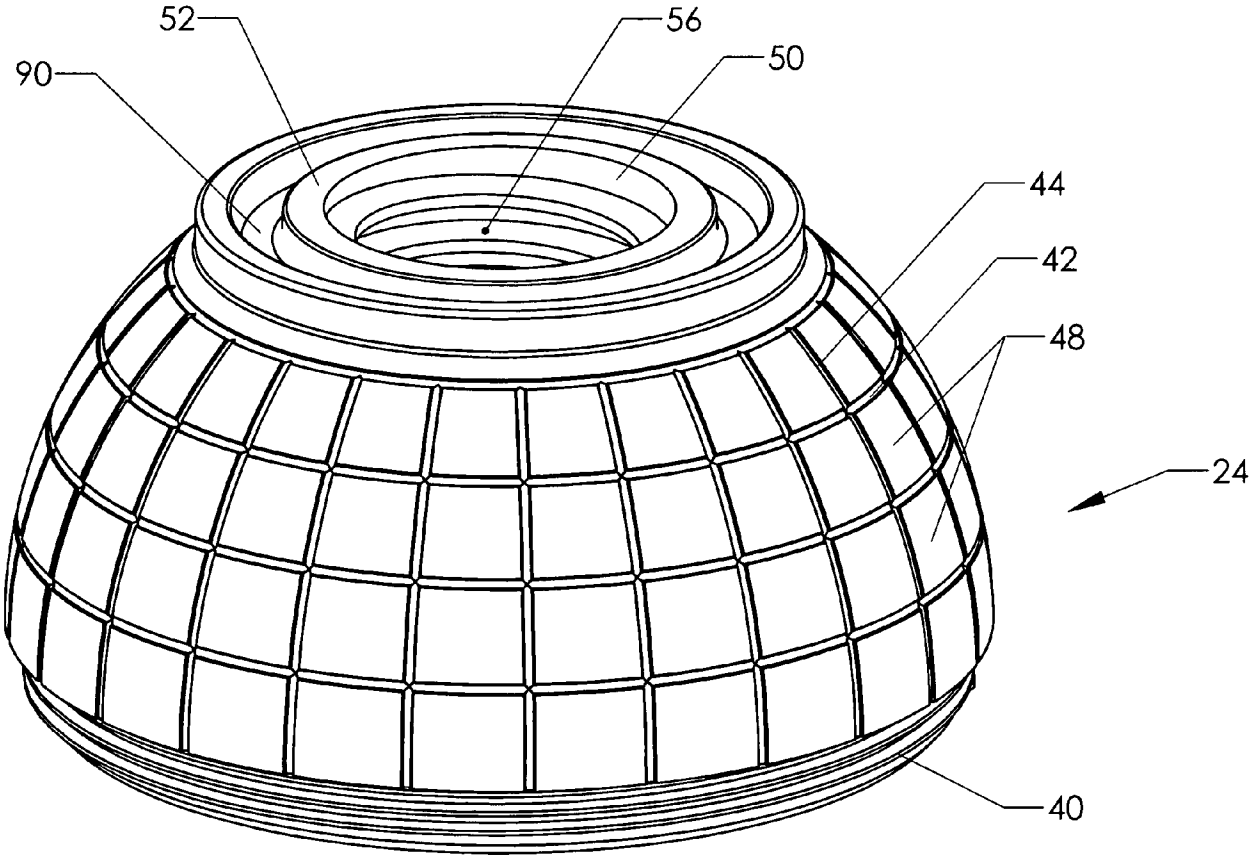
FIG. 7 is a perspective view, showing the base.

FIG. 7 depicts base 24 in a perspective view. Fuse receiver 56 is a hole sized to receive fuse assembly 12. It includes female thread 50 (which engages a corresponding male thread on the fuse assembly. Outer mating face 52 surrounds the fuse receiver. When the fuse assembly is installed, an inward facing face of the fuse assembly bears against outer mating face 52 to form a seal. A seal enhancing feature is preferably included. In the embodiment shown, gasket seat 90 is provided. It retains an elastic O-ring which forms a positive seal with the fuse assembly. As for the nose cap, base 24 includes a plurality of latitude channels 42 and longitude channels 44 which divide its exterior surface into a plurality of panels 48.

Figure 8:
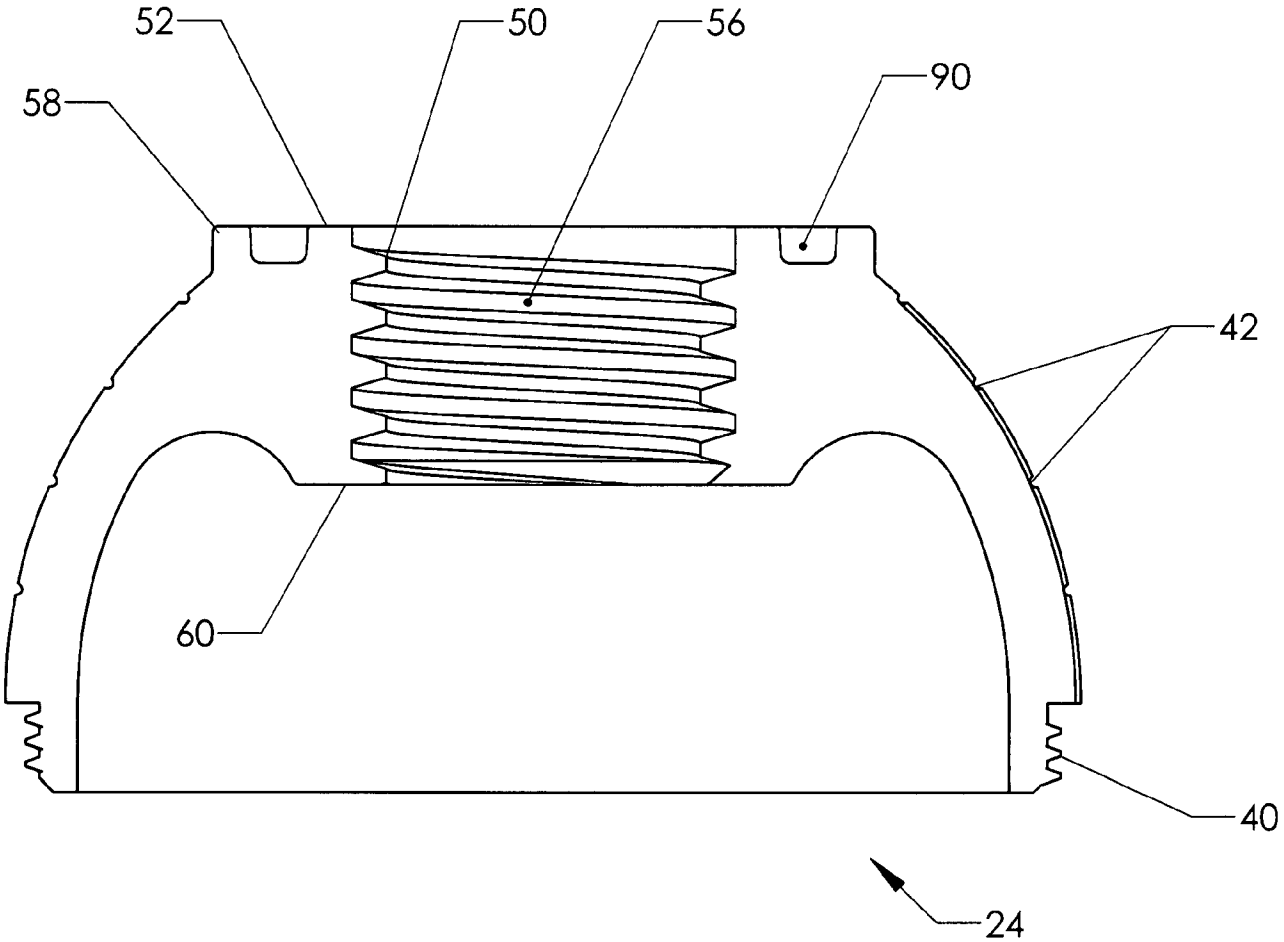
FIG. 8 is a sectional elevation view of the base of FIG. 7.
Figure 9:
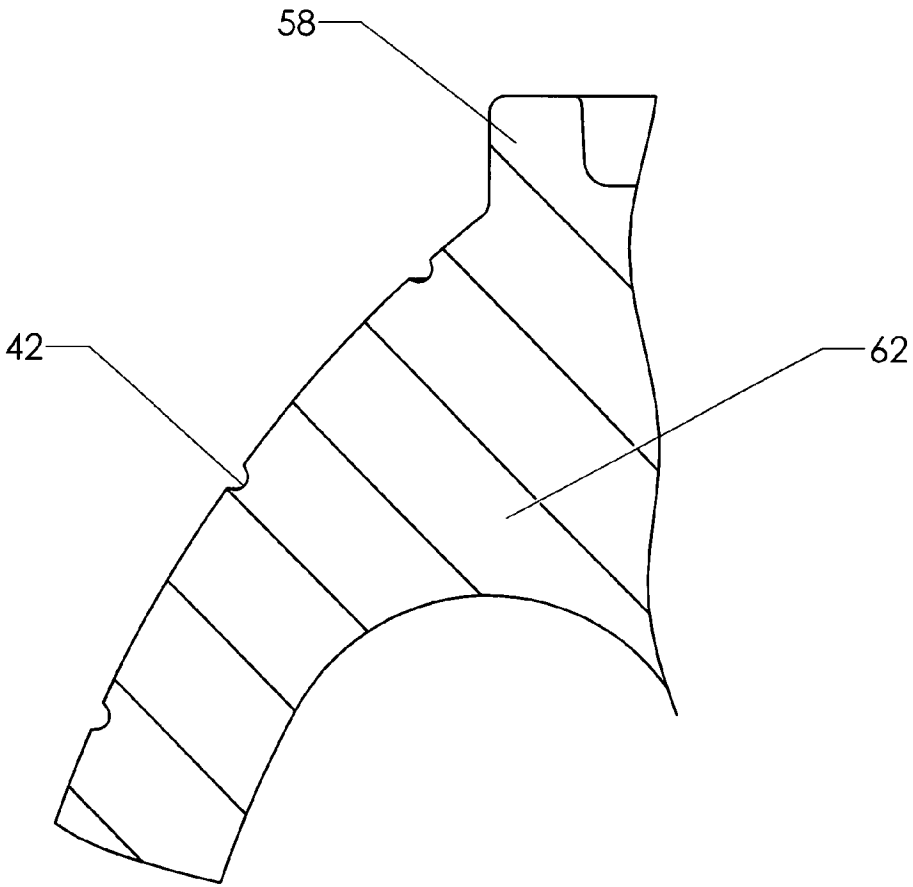
FIG. 9 is a sectional detail view, showing the wall of the base.

FIG. 8 shows a sectional elevation view through base 24. The reader will observe how fuse receiver 56 passes through from the exterior surface to the interior surface. Inner mating face 60 is positioned to bear against the core sleeve—as will be explained subsequently. Gasket seat 90 is provided in a flat upstanding boss 58. Male thread 40 is provided to engage the female thread on the second end of sleeve 26. FIG. 9 shows a detail of wall 62 of base 24—illustrating how the channels (in this case lateral channel 42) create local reductions in wall thickness to provide predictable fragmentation. As for the nose cap, the base is preferably made of a dense and strong material such as steel.

Figure 10:
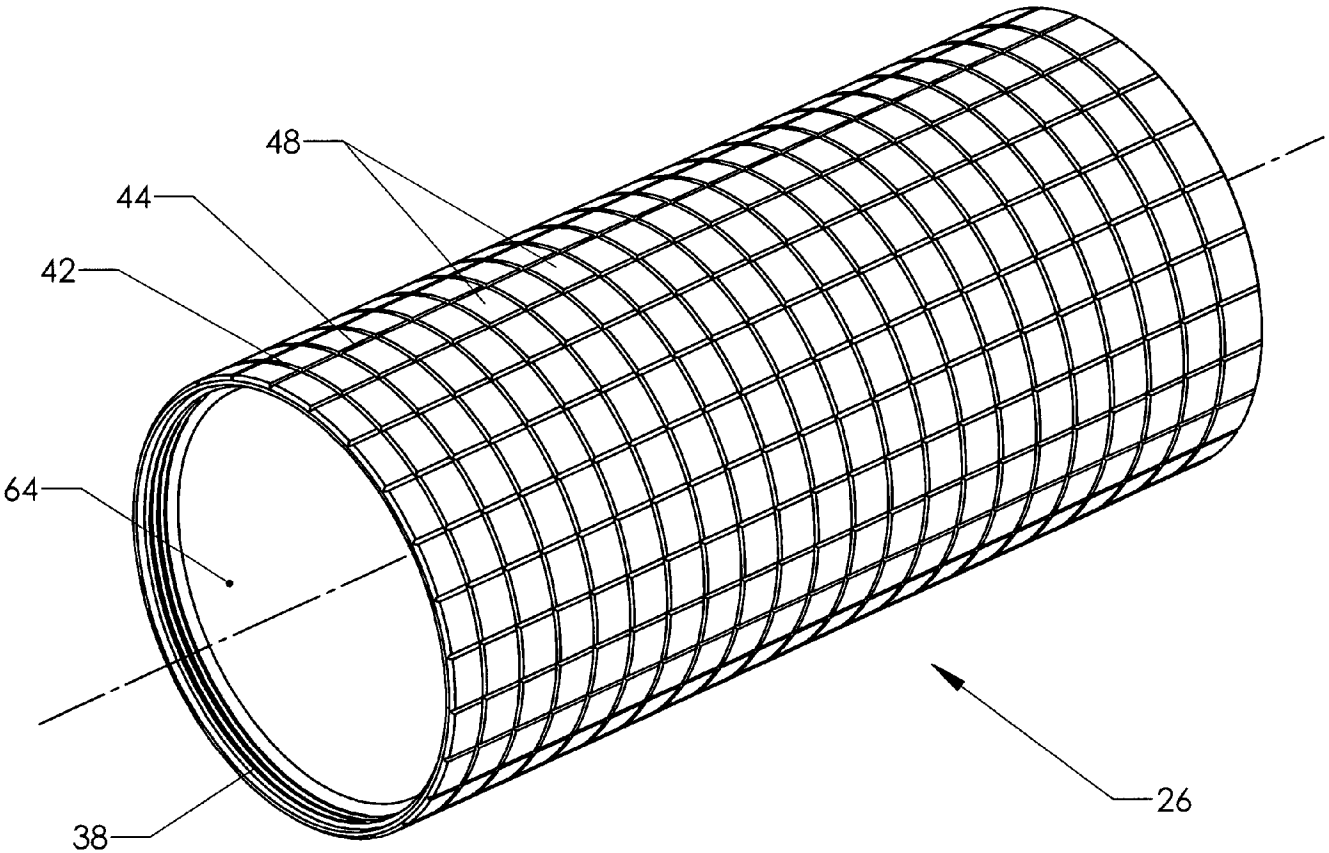
FIG. 10 is a perspective view, showing the sleeve.

FIG. 10 is a perspective view of sleeve 26. This is preferably made as a relatively thick-walled cylinder. The first end includes nose cap receiver 64—featuring female thread 38. The outer surface of sleeve 26 includes longitude channels 44 and latitude channels 42. These divide the exterior into panels 48.

Figure 11:
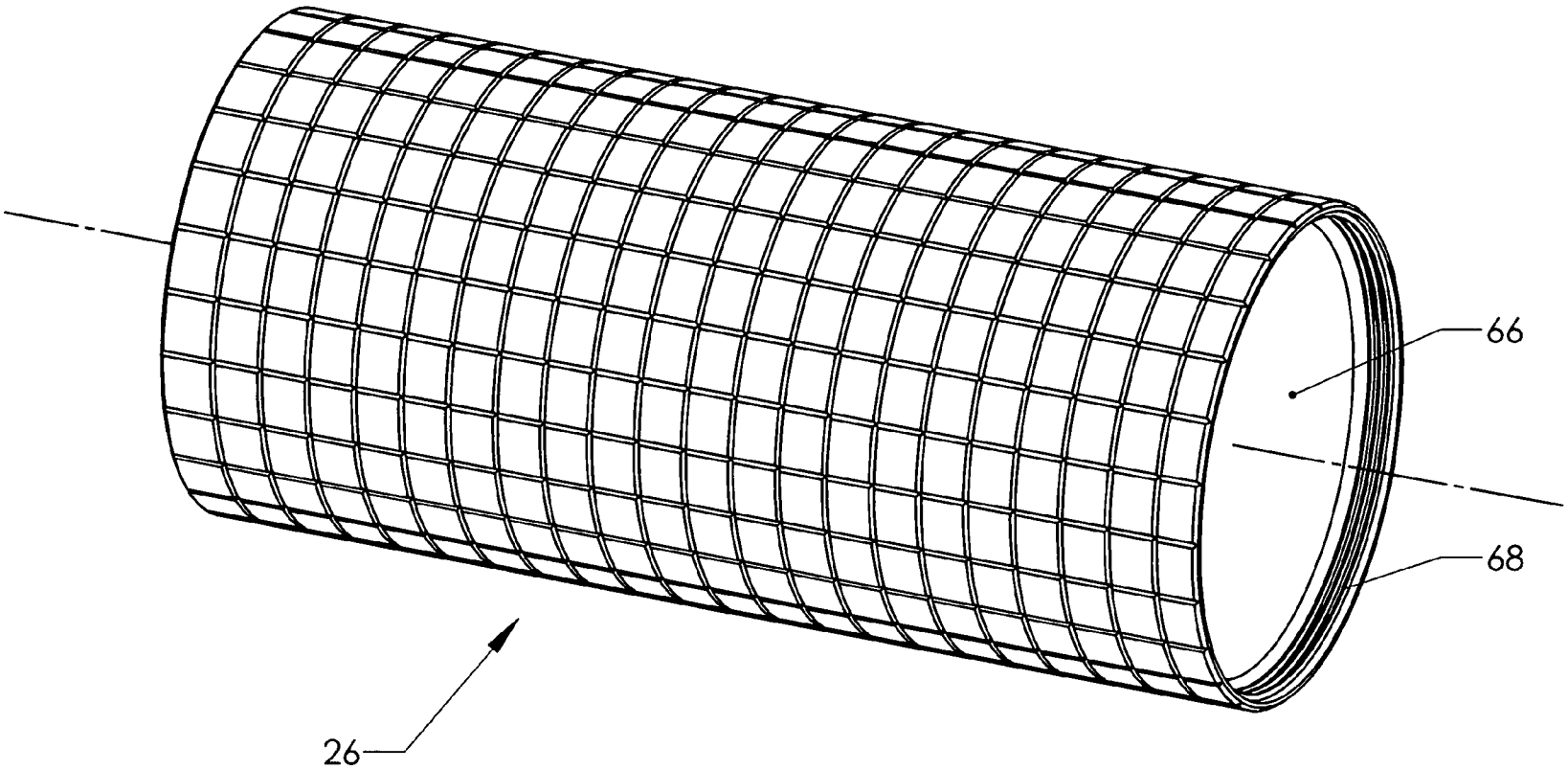
FIG. 11 is a perspective view, showing the sleeve from another vantage point.
Figure 12:
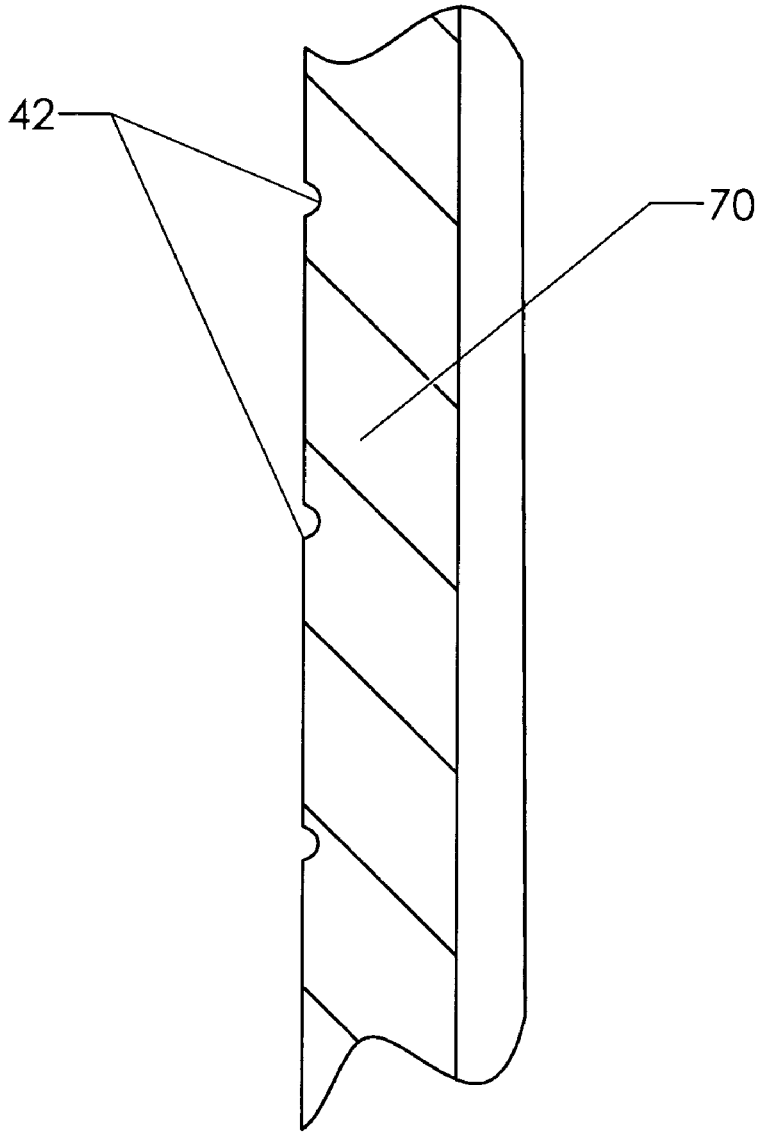
FIG. 12 is a sectional detail view, showing the wall of the sleeve.

FIG. 11 shows the second end of sleeve 26. Base receiver 66 is configured to attach to the base, and female thread 68 is provided for this purpose. The interior surface of sleeve 46 is preferably made smooth to facilitate the loading of the explosive. FIG. 12 is a detailed sectional view, showing how the inclusion of the channels (in this case latitude channels 42) creates fracture lines in wall 70 of sleeve 26.

Figure 13:
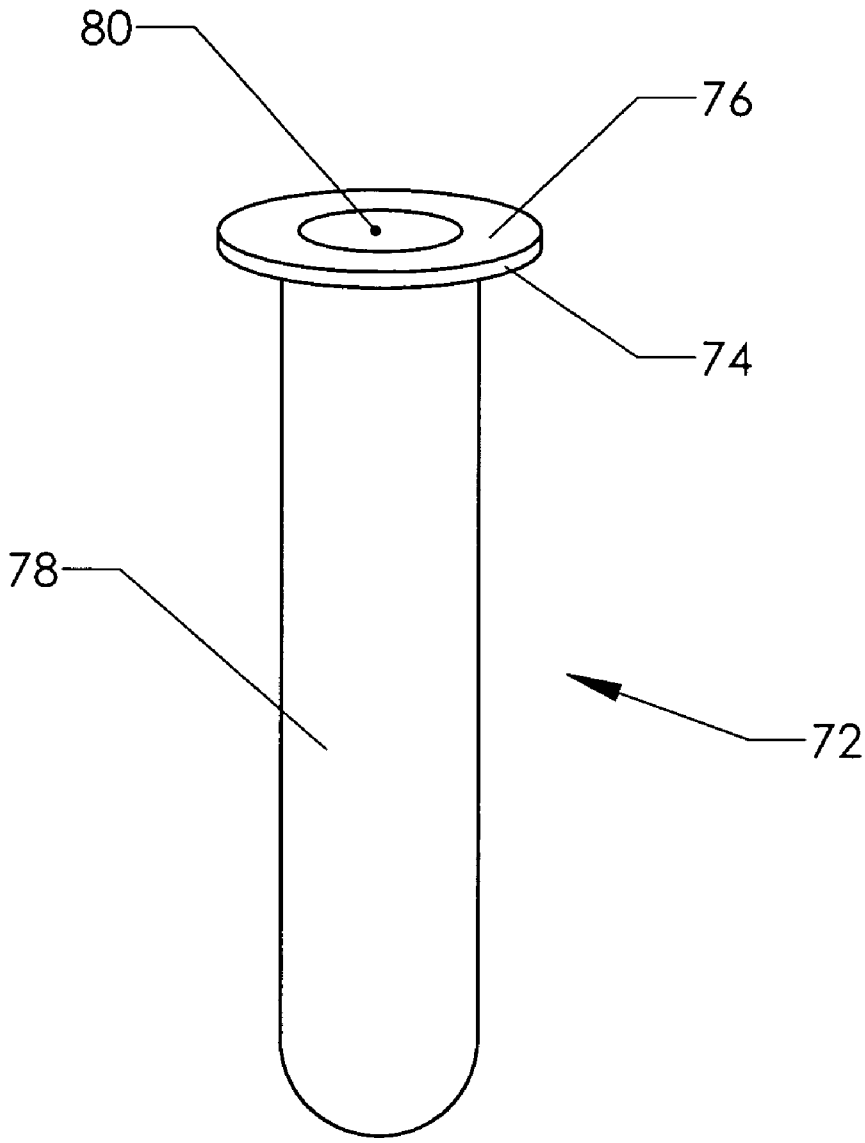
FIG. 13 is a perspective view, showing the core sleeve.

FIG. 13 shows core sleeve 72 in more detail. This component separates the igniter portion of the fuse from the explosive contained within the grenade. It is preferably of thin-walled construction so that it may be easily breached. The part is preferably drawn out of a ductile material such as copper. Tube 78 is drawn to an extended length. Flange 74 is provided so that mating surface 76 can bear against inner mating face 60 of base 24. Hollow interior is sized to admit the relevant components of the fuse assembly.

Figure 14:
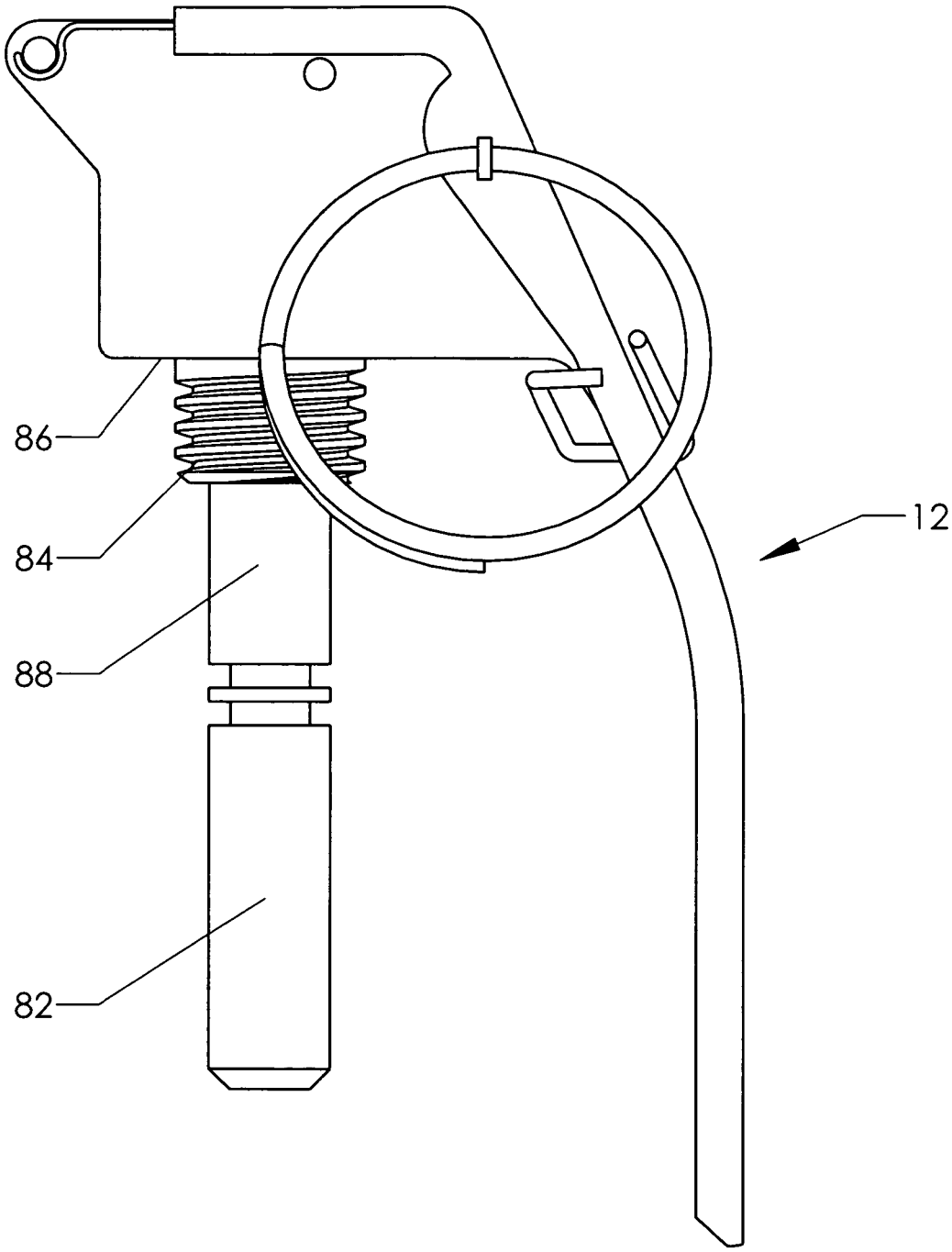
FIG. 14 is an elevation view, showing the fuse assembly.

FIG. 14 is an elevation view showing more details of fuse assembly 12. Mating surface 86 bears against the O-ring contained within gasket seat 90 of base 24. Male thread 84 threads into female thread 50 in base 24. Descending from the triggering portion of the fuse assembly is a column containing delay element 88 and detonator 82. These extend into the interior of core sleeve 72 when the grenade is assembled. When the pin is pulled and the grenade is thrown, the delay element is triggered. It burns for an established interval (typically 5 seconds) before igniting detonator 82. The detonator then ruptures the core sleeve and detonates the A5 within the grenade body.

Figure 15:
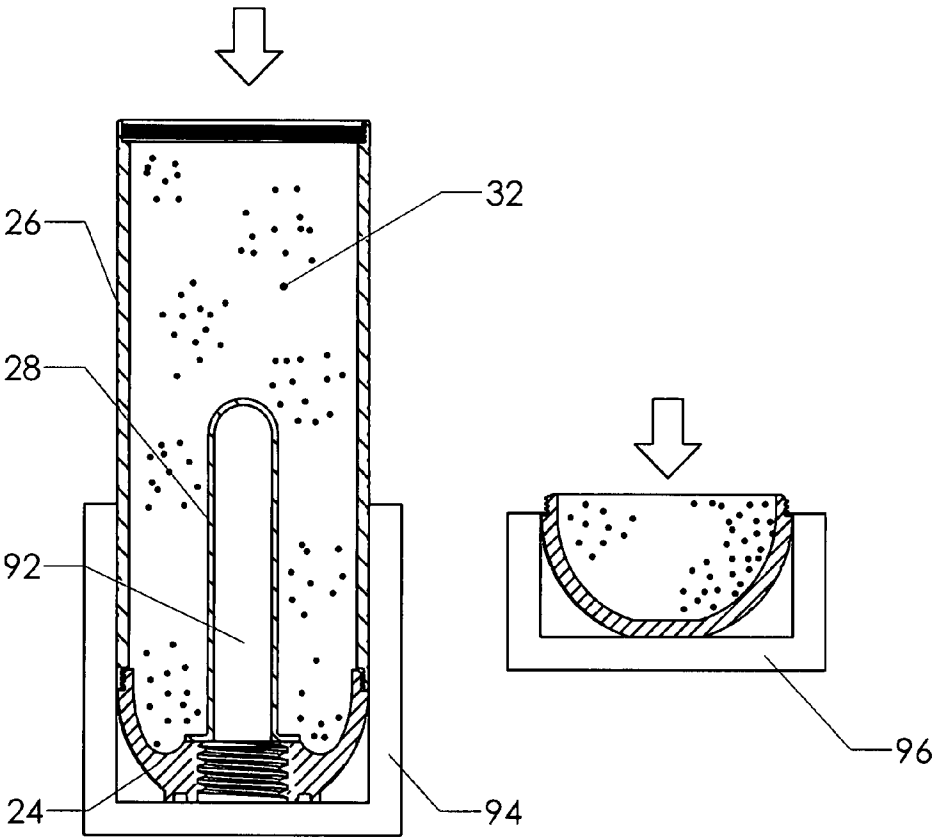
FIG. 15 is a sectional elevation view, showing the assembly process.

The unique construction of the invention lends itself to manufacturing. As mentioned previously, A5 must generally be pressed into place (as opposed to granular nitrocellulose powders which may be simply poured through an opening). FIG. 15 shows a simplified representation of the A5 loading process. Base 24 is first attached to sleeve 26. Holding fixture 94 is provided. It includes locating pin 92. The sleeve and base assembly is placed in holding fixture 94. Core sleeve 28 is then placed over locating pin 92, which properly locates the core sleeve with respect to the rest of the grenade assembly. An adhesive or sealant can be used to secure the flange of the core sleeve to base 24.

Explosive 32 (preferably A5) is then introduced through the opening. The explosive is compressed—typically using a ram. Once compressed the explosive fuses into a solid mass. The assembly of base 24, sleeve 26, and cores sleeve 28 may then be lifted free of the holding fixture and its associated pin. Because the explosive has been fused into a solid mass, the components will remain in the position shown even after the assembly has been lifted free of locating pin 92.

The nose cap is also shown being loaded in holding fixture 96. Flat 46 on the nose cap may be placed against the bottom of holding fixture 96 to positively locate the component. Explosive is then introduced and pressed into place. As for the sleeve/bases assembly, the explosive is preferably fused into a solid mass that will hold its shape once the nose cap is removed from holding fixture 96.

Separate holding fixtures are shown for the base/sleeve assembly and for the nose cap. A third fixturing device (locating pin 92) is provided for core sleeve 28. Those skilled in the art will know that such fixtures can be combined into a single fixture. Thus, although a first holding fixture, second holding fixture, and third holding fixture are illustrated—these should not necessarily be thought of as separate items.

The explosive pressing process produces a solid mass of A-5 in both the base/sleeve assembly and the nose cap. In some embodiments it is desirable to leave the nose cap and the base/sleeve assembly separate (for reasons that will be made apparent subsequently). The reader will observe that the compressed explosive within the base/sleeve assembly has an exposed surface (facing upward in the view). The compressed explosive within the nose cap also has an exposed surface facing upward. These exposed surfaces are preferably sealed so that moisture and other contaminants cannot enter the device prior to the mating of the nose cap to the rest of the hand grenade.

Once the explosive is loaded, the nose cap and sleeve/base assembly may be threaded together. FIG. 2 shows the two sub-assemblies joined together. Joint 34 is formed between the explosive within the nose cap and the explosive within the sleeve. It is preferable to eliminate any voids at this interface. Thus, filler material is preferably introduced at joint 34 during the assembly process. A two part epoxy is a suitable filler material.

The modular nature of the device allows more many variations—particularly with the nose cap. The reader will observe that once the propellant has been pressed into place, the nose cap can be attached to or removed from the balance of the hand grenade. This allows for the use of different types of nose caps. Interchangeable nose caps are preferably provided, with the decision of which type to use being left to the soldier in the field.

Figure 16:
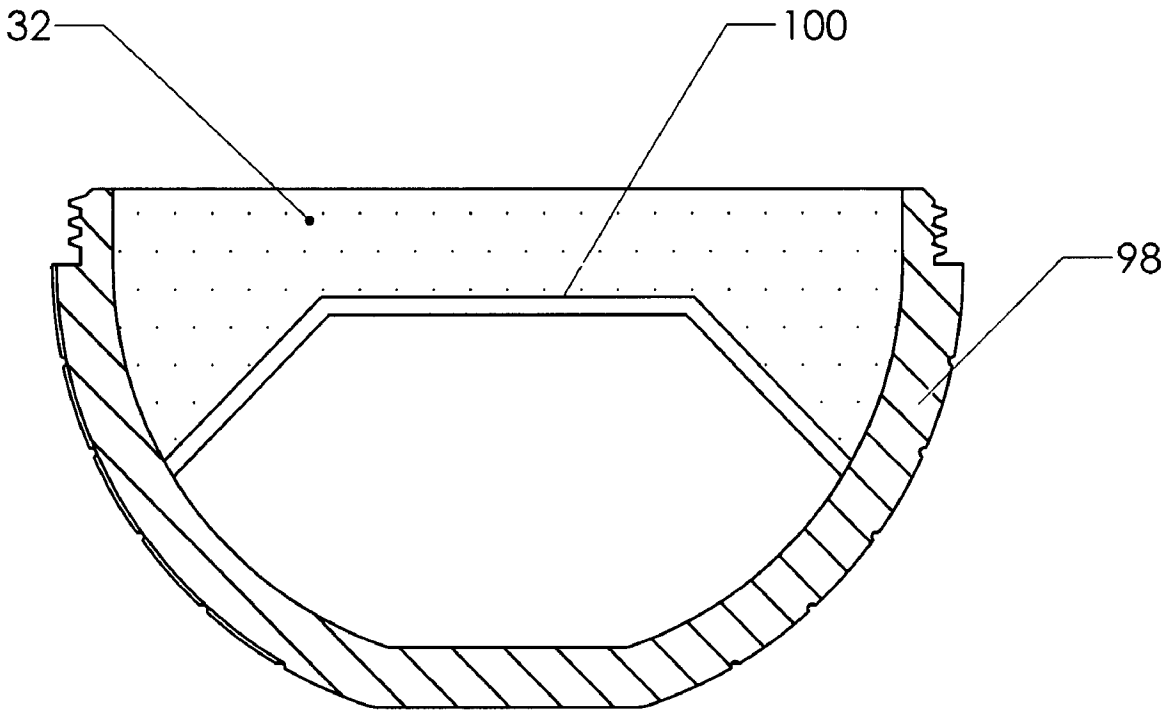
FIG. 16 is a sectional elevation view, showing an alternate nose cap incorporating a shaped charge.
Figure 17:
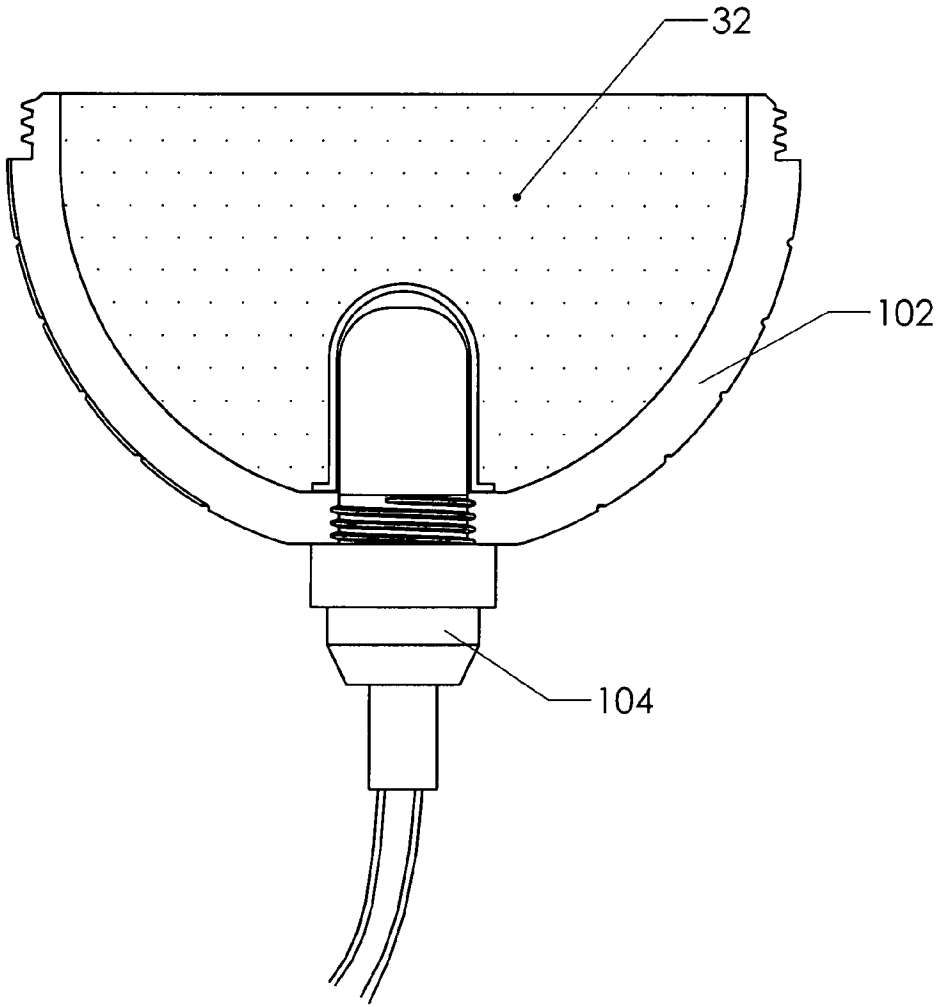
FIG. 17 is a sectional elevation view, showing an alternate nose cap incorporating an electrical detonator.

FIGS. 16 and 17 show two examples of the many types of nose caps which could be provided. FIG. 16 shows shaped charge nose cap 98. Copper cup 100 is provided to contain explosive 32 and form it into a desired shape. The nose cap is then attached to the balance of the grenade. When the grenade fires, the copper cup will be collapsed into a stream of plasma—as is understood by those knowledgeable in the field of munitions. This allows the grenade to penetrate thick metal plates and even armored vehicles.

FIG. 17 shows another alternate nose cap—detonator nose cap 102. This embodiment includes a detonator receiver configured to accommodate an electrically triggered detonator 104. This nose cap is also screwed into the body of the grenade. It allows the user to place the grenade and remotely detonate it using an electrical signal. This embodiment also allows two or more grenades to be simultaneously detonated using an electrical signal.

The embodiments of FIGS. 16 and 17 can be factory-created variations. Of course, it may well be preferable to provide the soldier with the option of changing among a variety of nose caps in the field. If this option is provided, it is important to prevent moisture ingress into the body of the grenade. A seal is therefore preferably provided over the exposed surface of the explosive in the nose cap and the explosive contained within the balance of the grenade. An example is a foil seal attached over each volume of explosive. This would allow the nose cap to remain off the body of the grenade without causing problems.

The modular nature of the grenade allows for many other variations. Returning to FIG. 2, the reader will note that the overall length of the grenade may be varied by varying the length of sleeve 26. This would vary the volume of explosive within the grenade and the resulting blast and fragmentation radius. A short version can be made to reduce the blast radius.

The grenade as pictured in FIG. 2 is relatively compact compared to the existing M67 hand grenade in present use. This results in part from the ability to use A5 explosive rather than the Comp B explosive used in the M67. The M67 is a spherical container that is loaded through a relatively small opening in the top. Comp B is a low melting-point material which can be poured through this opening. It would not be possible to load A5 into the M67, however, because it would not be possible to press it into place.

The use of the A5 in place of Comp B allows either (1) a much more powerful grenade having similar dimensions; or (2) a comparably powerful grenade having significantly smaller dimensions. The present grenade is relatively slender—having a diameter of about 1.5 inches (or 37 mm). An M67 has a diameter of about 2.5 inches (or 67 mm). The reduced diameter allows a soldier having a smaller hand to more easily grip and throw the grenade. In addition, the slender configuration allows the present invention to more easily be carried in a pocket or other holding device on a tactical vest.

The illustrations show the use of an existing fuse assembly with a safety handle configured for use with the M67 grenade. The reader will observe in FIG. 2 that the safety handle could be reconfigured to lie more closely along sleeve 26. Such an alternate embodiment could easily be provided and this would further enhance the ergonomics of the design. The current "safety clip" is likely to be replaced by a new "confidence clip" and the design is compatible with that feature as well.

The preferred use of the machined channels on the exterior surface of the components allows the channel spacing to be altered without requiring expensive dedicated tooling. It is simple to use a lathe, a broach, or a grinding device to create the channels. The channel variation allows the size of the fragments produced upon detonation to be varied as desired.

The reader will thereby appreciate that the present invention provides a modular hand grenade design with numerous advantages over the existing designs. The foregoing description and drawings comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Many modifications and other embodiments of the invention will come to mind to one skilled in the art to which this invention pertains having the benefit of the teachings presented in the foregoing descriptions and the associated drawings. Although specific terms may be employed herein, they are used in a generic and descriptive sense only and not for purposes of limitation. Accordingly, the present invention is not limited to the specific embodiments illustrated herein, but is limited only by the following claims.

We claim:

1. A method for manufacturing a hand grenade, comprising:

a. providing a base including a fuse receiver;
b. providing a sleeve attached to said base, with said base and said sleeve defining an enclosed interior;
c. providing a core sleeve;
d. providing a first holding fixture configured to hold said base with said attached sleeve;
e. providing a core sleeve locating fixture;
f. placing said base and said attached sleeve in said first holding fixture;
g. placing said core sleeve in said enclosed interior inside said base and said sleeve, with said core sleeve being located by said core sleeve locating fixture;
h. providing an explosive which can be compressed to form a solid;
i. filling said interior of said base and said sleeve with said explosive;
j. compressing said explosive lying within said interior of said base and said sleeve to form a solid;
k. providing a nose cap; and
l. attaching said nose cap to said sleeve.

2. A method for manufacturing a hand grenade as recited in claim 1, further comprising:

a. wherein said nose cap has an interior;
b. providing a nose cap holding fixture;
c. placing said nose cap in said nose cap holding fixture;
d. filling said nose cap with said explosive; and e. compressing said explosive lying within said interior of said nose cap to form a solid before attaching said nose cap to said sleeve.

3. A method for manufacturing a hand grenade as recited in claim 1, further comprising:

a. wherein after said explosive lying within said interior of said base and said sleeve has been compressed to form a solid said solid has an exposed surface; and b. sealing said exposed surface of said solid explosive within said interior of said base and said sleeve.

4. A method for manufacturing a hand grenade as recited in claim 1, wherein:

a. said sleeve has a first end and a second end;

b. said first end of said sleeve is attached to said base;

c. said second end of said sleeve includes a thread;

d. said nose cap includes a thread; and e. said nose cap is attached to said sleeve by engaging said thread on said nose cap with said thread on said sleeve.

5. A method for manufacturing a hand grenade as recited in claim 4, wherein:

a. said sleeve has a first end and a second end;

b. said first end of said sleeve includes a thread;

c. said base includes a thread; and d. said sleeve is attached to said base by engaging said thread on said first end of said sleeve with said thread on said base.

6. A method for manufacturing a hand grenade as recited in claim 4, further comprising:

a. providing a fuse assembly; and b. attaching said fuse assembly to said fuse receiver in said base.

7. A method for manufacturing a hand grenade as recited in claim 1, wherein said base and said sleeve are formed as one integral piece.

8. A method for manufacturing a hand grenade as recited in claim 1, further comprising:

a. wherein said nose cap has an interior with an open end;

b. providing a copper cup configured to create a shaped charge geometry;

c. placing said copper cup in said interior of said nose cap to divide said interior into a first volume that is completely enclosed and a second volume proximate said open end of said interior of said nose cap;

d. filling said second volume proximate said open end of said interior of said nose cap with explosive; and e. compressing said explosive lying within said interior of said nose cap to form a solid before attaching said nose cap to said sleeve.

9. A method for manufacturing a hand grenade as recited in claim 8, further comprising:

a. wherein after said explosive lying within said interior of said base and said sleeve has been compressed to form a solid said solid has an exposed surface; and b. sealing said exposed surface of said solid explosive within said interior of said base and said sleeve.

10. A method for manufacturing a hand grenade as recited in claim 8, wherein:

a. said sleeve has a first end and a second end;

b. said first end of said sleeve is attached to said base;

c. said second end of said sleeve includes a thread;

d. said nose cap includes a thread; and e. said nose cap is attached to said sleeve by engaging said thread on said nose cap with said thread on said sleeve.

11. A method for manufacturing a hand grenade as recited in claim 10, wherein:

a. said sleeve has a first end and a second end;

b. said first end of said sleeve includes a thread;

c. said base includes a thread; and d. said sleeve is attached to said base by engaging said thread on said first end of said sleeve with said thread on said base.

12. A method for manufacturing a hand grenade as recited in claim 8, wherein said base and said sleeve are formed as one integral piece.

13. A method for manufacturing a hand grenade as recited in claim 8, further comprising:

a. providing a fuse assembly; and b. attaching said fuse assembly to said fuse receiver in said base.

14. A method for manufacturing a hand grenade, comprising:

a. providing a base including a fuse receiver;

b. providing a sleeve attached to said base, with said base and said sleeve defining an enclosed interior;

c. providing a core sleeve;

d. providing a first holding fixture configured to hold said base with said attached sleeve;

e. providing a core sleeve locating fixture;

f. placing said base and said attached sleeve in said first holding fixture;

g. placing said core sleeve in said enclosed interior inside said base and said sleeve, with said core sleeve being located by said core sleeve locating fixture;

h. providing an explosive which can be compressed to form a solid;

i. filling said interior of said base and said sleeve with said explosive; and j. compressing said explosive lying within said interior of said base and said sleeve to form a solid.

15. A method of manufacturing a hand grenade as recited in claim 14, further comprising:

a. providing a nose cap having an interior;

b. filling said interior of said nose cap with said explosive;

c. compressing said explosive lying within said interior of said nose cap to form a solid; and d. attaching said nose cap to said sleeve.

16. A method of manufacturing a hand grenade as recited in claim 14, further comprising:

a. providing a nose cap with an interior having an open end;

b. providing a copper cup configured to create a shaped charge geometry;

c. placing said copper cup in said interior of said nose cap to divide said interior into a first volume that is completely enclosed and a second volume proximate said open end of said interior of said nose cap;

d. filling said second volume proximate said open end of said interior of said nose cap with said explosive;

e. compressing said explosive lying within said interior of said nose cap to form a solid before attaching said nose cap to said sleeve; and f. attaching said nose cap to said sleeve.

17. A method of manufacturing a hand grenade as recited in claim 14, further comprising:

a. providing a nose cap with an interior having an open end;

b. providing a detonator receiver in said nose cap opposite said open end;

c. filling said nose cap with said explosive through said open end;

d. compressing said explosive lying within said nose cap to form a solid; and e. attaching said nose cap to said sleeve.

18. A method of manufacturing a hand grenade as recited in claim 14, further comprising:

a. wherein said compressed solid explosive lying within said interior of said base and said sleeve has an exposed surface; and b. sealing said exposed surface of said solid explosive within said interior of said base and said sleeve.

19. A method of manufacturing a hand grenade as recited in claim 18, further comprising:

a. providing a nose cap with an interior having an open end;

b. filling said nose cap with said explosive through said open end;

c. compressing said explosive lying within said nose cap to form a solid having an exposed surface; and d. sealing said exposed surface of said solid lying within said nose cap.

20. A method of manufacturing a hand grenade as recited in claim 19, further comprising attaching said nose cap to said sleeve.

* * * * *